US011484123B2

(12) United States Patent
Osti et al.

(10) Patent No.: US 11,484,123 B2
(45) **Date of Patent: *Nov. 1, 2022**

(54) DYNAMIC POSTURAL DEVICE

(71) Applicants: Leonardo Osti, Modena (IT); Raffaella Osti, Ferrara (IT)

(72) Inventors: Leonardo Osti, Modena (IT); Raffaella Osti, Ferrara (IT)

( * ) Notice: Subject to any disclaimer, the term of this patent is extended or adjusted under 35 U.S.C. 154(b) by 87 days.

This patent is subject to a terminal disclaimer.

(21) Appl. No.: 16/323,232

(22) PCT Filed: Aug. 4, 2017

(86) PCT No.: PCT/IB2017/054789
§ 371 (c)(1),
(2) Date: Feb. 4, 2019

(87) PCT Pub. No.: WO2018/025235
PCT Pub. Date: Feb. 8, 2018

(65) Prior Publication Data

US 2019/0174923 A1 Jun. 13, 2019

(30) Foreign Application Priority Data

Aug. 5, 2016 (IT) ..... 102016000083098

(51) Int. Cl.
*A47C 7/02* (2006.01)
*A47C 3/029* (2006.01)
*A47C 9/00* (2006.01)
*A47C 16/02* (2006.01)

(52) U.S. Cl.
CPC ..... *A47C 7/021* (2013.01); *A47C 3/029* (2013.01); *A47C 7/024* (2013.01); *A47C 9/002* (2013.01); *A47C 16/025* (2013.01)

(58) Field of Classification Search
CPC ..... A47C 7/021; A47C 3/029; A47C 7/024; A47C 9/002; A47C 16/025; A63B 22/16; A63B 22/18; A63B 26/003; A63B 23/0233; A63B 71/0054; A63B 2071/0072; A63B 2208/0204; A63B 2022/0038; A63B 2022/185; A63B 2071/027; A63B 23/08
USPC ..... 5/653
See application file for complete search history.

(56) References Cited

U.S. PATENT DOCUMENTS 2,156,629 A 5/1939 Hutchison
3,512,419 A * 5/1970 Stiles ..... G01C 19/22 74/5 F
4,285,516 A * 8/1981 Heatwole ..... A63B 21/0004 482/146

(Continued)

FOREIGN PATENT DOCUMENTS

DE 202013010263 U1 * 7/2014 ..... A63B 21/4015
DE 202013104026 U1 * 12/2014 ..... A61H 1/008

(Continued)

*Primary Examiner* — Myles A Throop
(74) *Attorney, Agent, or Firm* — David B. Tingey; Bryant J. Keller; Kirton McConkie

(57) ABSTRACT

The dynamic postural device comprises two oscillating elements having respectively: —a seating portion to support a buttock of a user; a supporting portion opposite to the seating portion and of a substantially convex shape; in which the supporting portion is adapted to allow the oscillation of the respective oscillating element as a result of the seating of the user.

16 Claims, 3 Drawing Sheets

(56) References Cited

U.S. PATENT DOCUMENTS 5,181,764 A * 1/1993 Wiener ..... A47C 7/024 297/230.1
5,292,296 A 3/1994 Davignon
5,580,128 A * 12/1996 Johnson ..... A47C 7/021 297/314
5,584,787 A 12/1996 Guidry
5,713,632 A * 2/1998 Su ..... A47C 7/024 297/312
5,730,690 A * 3/1998 Guidry ..... A63B 21/0004 482/146
5,976,097 A * 11/1999 Jensen ..... A47C 7/024 297/330
6,139,095 A * 10/2000 Robertshaw ..... A47C 7/024 297/105
6,848,742 B1 * 2/2005 Aoki ..... B60N 2/5635 297/180.14
7,278,688 B1 * 10/2007 Hung ..... A47C 7/024 297/285
10,709,252 B2 * 7/2020 Volk ..... A47C 7/004
2005/0173951 A1 * 8/2005 Jalkanen ..... A47C 9/002 297/201
2005/0179293 A1 * 8/2005 Wilcox ..... A47C 7/14 297/313
2006/0030463 A1 * 2/2006 Maloy ..... A63B 23/1281 482/126
2006/0152053 A1 * 7/2006 Kim ..... A47C 7/024 297/312
2007/0007808 A1 * 1/2007 van Deursen ..... A47C 9/002 297/344.21
2007/0111862 A1 * 5/2007 Lockett ..... A63B 22/18 482/51
2008/0265641 A1 * 10/2008 Kim ..... A47C 7/024 297/312
2013/0009441 A1 * 1/2013 Carmichael, IV ..... A47C 7/02 297/451.2
2015/0061336 A1 * 3/2015 Ku ..... A47C 1/023 297/283.2
2015/0173515 A1 * 6/2015 Freedman ..... A47C 3/025 297/314
2016/0296024 A1 * 10/2016 Nishimiya ..... A61F 5/01
2016/0361603 A1 * 12/2016 Blinova ..... A63B 23/0238
2019/0054348 A1 * 2/2019 Polinsky ..... A63B 21/00065
2019/0082848 A1 * 3/2019 McClintock ..... A47C 3/20
2020/0016454 A1 * 1/2020 Osti ..... A63B 22/18

FOREIGN PATENT DOCUMENTS

EP 3120733 A1 * 1/2017 ..... A63B 21/0004
WO 2004/062434 A1 7/2004
WO WO-2015080231 A * 6/2015 ..... A47C 7/021

* cited by examiner

DYNAMIC POSTURAL DEVICE

TECHNICAL FIELD

The present invention relates to a dynamic postural device.

BACKGROUND ART

It is known that a physiologically incorrect posture, particularly for people who remain in a static and sedentary position for a long time, can lead to an uneven distribution of pressures that, by discharging onto the spine, rachis and intervertebral discs, cause a series of possible osteoarticular pathologies.

Indeed, sedentariness is one of the major causes of the aforementioned pathologies, together with the lack of movement that causes an accelerated aging of the intervertebral discs, thus accelerating the degenerative processes related to the age.

Specifically, sedentariness together with incorrect postures are linked either to unsuitable seating devices or precisely to the assumption of incorrect postures often directly related to muscular fatigue caused by staying in the same position for a long time.

Additionally, according to recent studies, maintaining good paravertebral muscle trophism and controlled and modulated movement are among the main and most effective prevention factors.

To date, the seating devices commonly used such as chairs and armchairs comprise a base structure provided with at least three elements resting on the ground often associated with wheels which are adapted to facilitate the displacement thereof in the surrounding environments, and a seating surface for the support of a user.

The seating surface is integrally associated with the base structure; in other words, the seating surface is static and its prolonged use over time is often among the major causes of osteoarticular pathologies.

Furthermore, the seating surface is associated with a lumbar supporting surface which is also generally at least partially blocked.

The static nature of the aforementioned surfaces for both seating and lumbar support makes these chairs and armchairs uncomfortable.

Additionally, the total lack of motion stimuli greatly accelerates the early aging process of the muscles.

In order to at least partly overcome the aforementioned drawbacks, several types of seating device are known which have the lumbar supporting surface and the seating surface movable relative to each other so as to vary the angle formed between the pelvis and the spine in order to counteract the tendency of the spine to curve.

Nevertheless, even in this case the prolonged use of such devices is awkward and uncomfortable.

The fact should also be added that they do not allow for balance control, in fact, they have no mobility adjustments systems for the lumbar supporting surfaces and for the seating surface or, likewise, temporary blocking systems of these. Another type of seating device has a base structure comprising at least three elements resting on the ground and adapted to support a spherical element of the type of a ball.

Generally, the spherical element is made of a flexible material and defines the seating surface.

In this case, the total instability of the seating surface makes these devices, generally made for medical and postural gymnastics, inadequate for prolonged seating over time; this is due to the lack of control on the seating surface, which causes stress and muscular fatigue for prolonged periods of time.

Another type of seating device comprises a base structure provided with at least one element resting on the ground comprising a supporting element of elongated conformation and having a first ending part associated in an unstable manner with the resting element and a second ending part associated with a seating surface.

The first ending part is associated with the resting element by interposition of a joint, e.g. of the universal type, which is adapted to make the seating surface unstable.

Even in this case, the total instability of the seating surface makes the aforementioned devices unsuitable for a prolonged use over time, often causing stress and muscular disease.

In detail, the lack of control puts the user into a situation of shaky and uncontrolled balance which makes the seat uncomfortable for prolonged periods of time.

Additionally, the aforementioned devices do not allow for an adequate air recirculation in the proximity of the gluteus region and in the lower part of the pelvis causing, particularly for prolonged periods of time, an increase in temperature at the lower external portion of the rachis; this increases the sensitivity, which is physiologically high in itself, to inflammatory conditions related to the temperature increase in that area.

In addition, the conformation of such devices is unsuitable to the anatomy and variability of conformation and extension of the gluteus region of each individual person, thus resulting in an uneven distribution of the charges in the sitting position.

DESCRIPTION OF THE INVENTION

The main aim of the present invention is to provide a dynamic postural device that allows making a seat with a controlled, modular balance and which can be fully blocked, if the case may be.

Another object of the present invention is to provide a dynamic postural device having a seating surface with reduced degrees of freedom and allowing the weight to be divided on the seating surface itself in an even manner.

Another object of the present invention is to provide a dynamic postural device which allows to overcome the aforementioned drawbacks of the prior art within the ambit of a simple, rational, easy, efficient to use and cost-effective solution. The aforementioned objects are achieved by this dynamic postural device having the characteristics of claim 1.

BRIEF DESCRIPTION OF THE DRAWINGS

Other characteristics and advantages of the present invention will become more evident from the description of a preferred, but not exclusive, embodiment of a dynamic postural device, illustrated by way of an indicative, but non-limiting example, in the attached drawings in which.

EMBODIMENTS OF THE INVENTION

Figure 1:
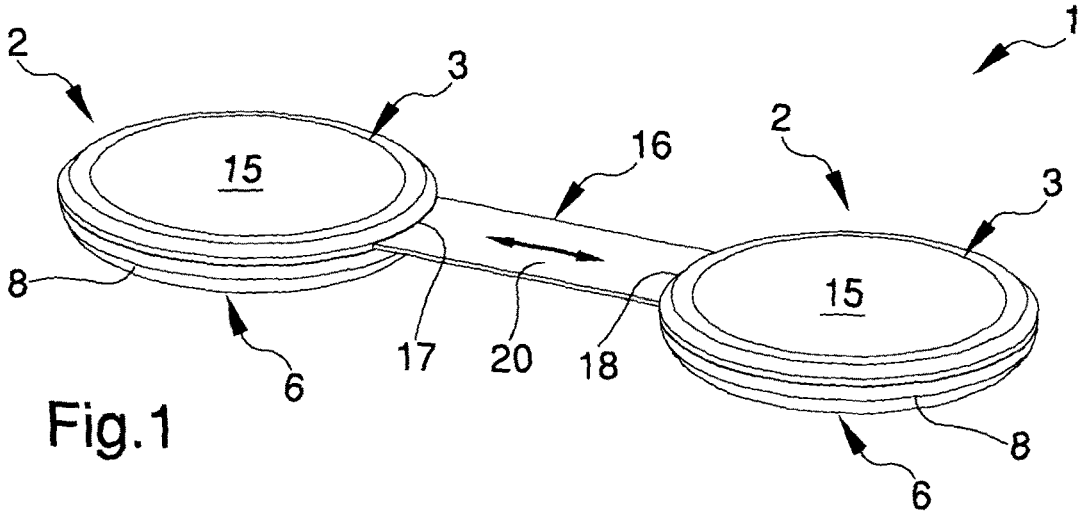
FIG. 1 is an axonometric view of the device according to the invention in a first embodiment.

With particular reference to these figures, reference numeral 1 globally indicates a dynamic postural device.

The device 1 comprises two oscillating elements 2.

The two oscillating elements 2 have respectively a seating portion 3 to support a buttock 4 of a user 5, and a supporting portion 6 opposite to the seating portion 3 and of substantially convex shape.

Specifically, the supporting portion 6 is adapted to allow the oscillation of the respective oscillating element 2 as a result of the user 5 sitting on it.

With reference to the particular embodiment shown in the figures, the oscillating elements 2 have a substantially circular conformation. Alternative embodiments with different conformations, i.e. quadrangular, cannot however be ruled out.

Figure 6:
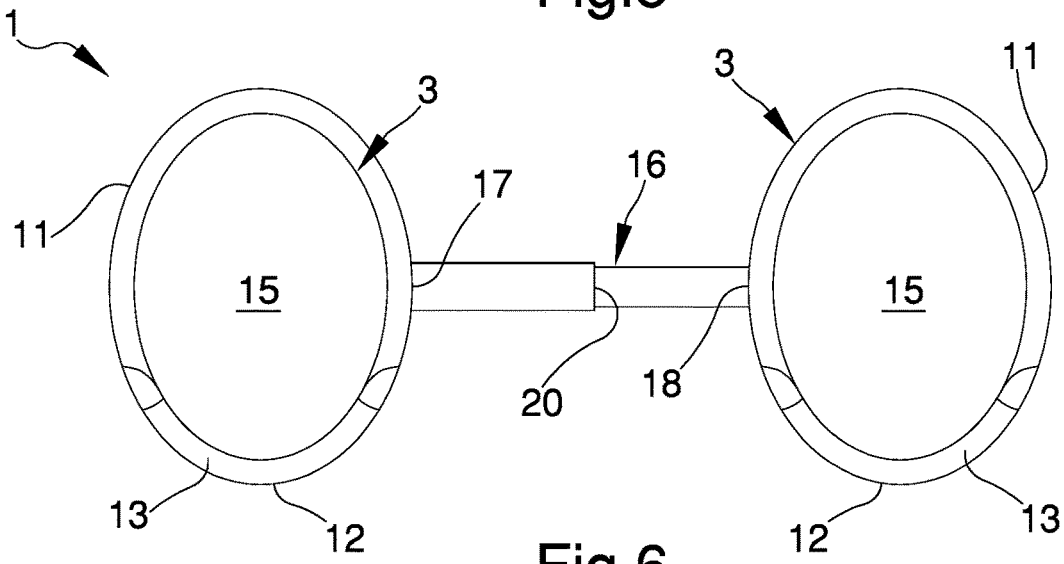
FIG. 6 is a plan view from above of the device according to the invention in a fifth embodiment.
Figure 8:
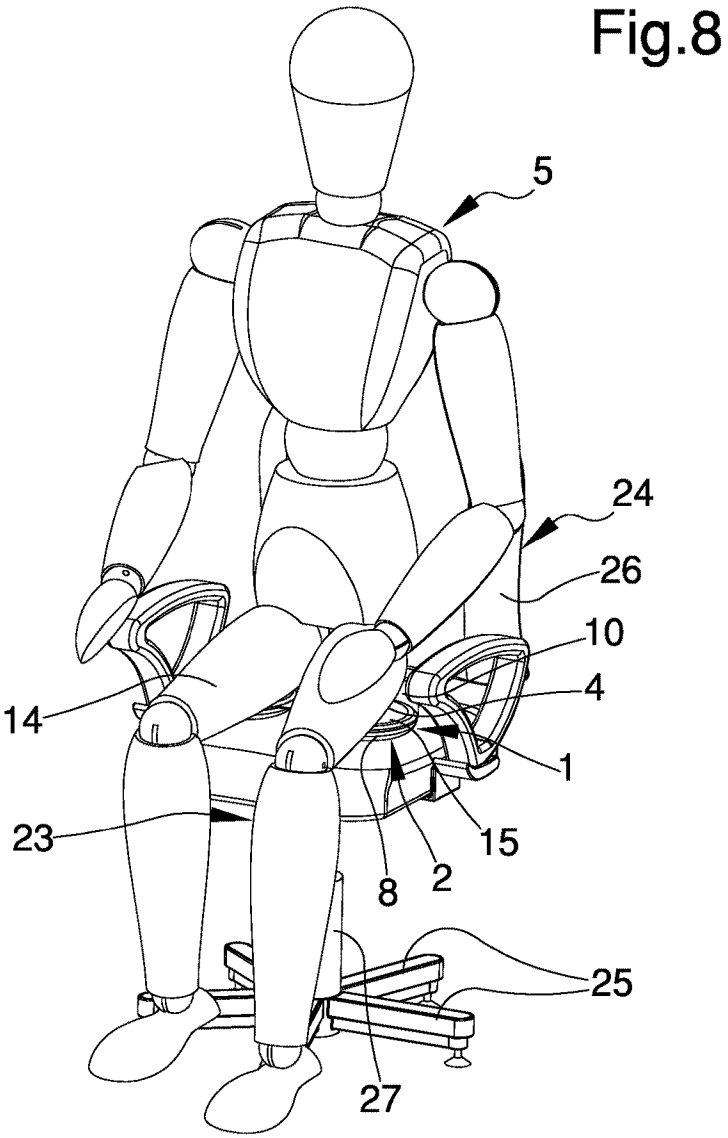
FIG. 8 is an axonometric view of the device according to the invention in the operating mode.
Figure 7:
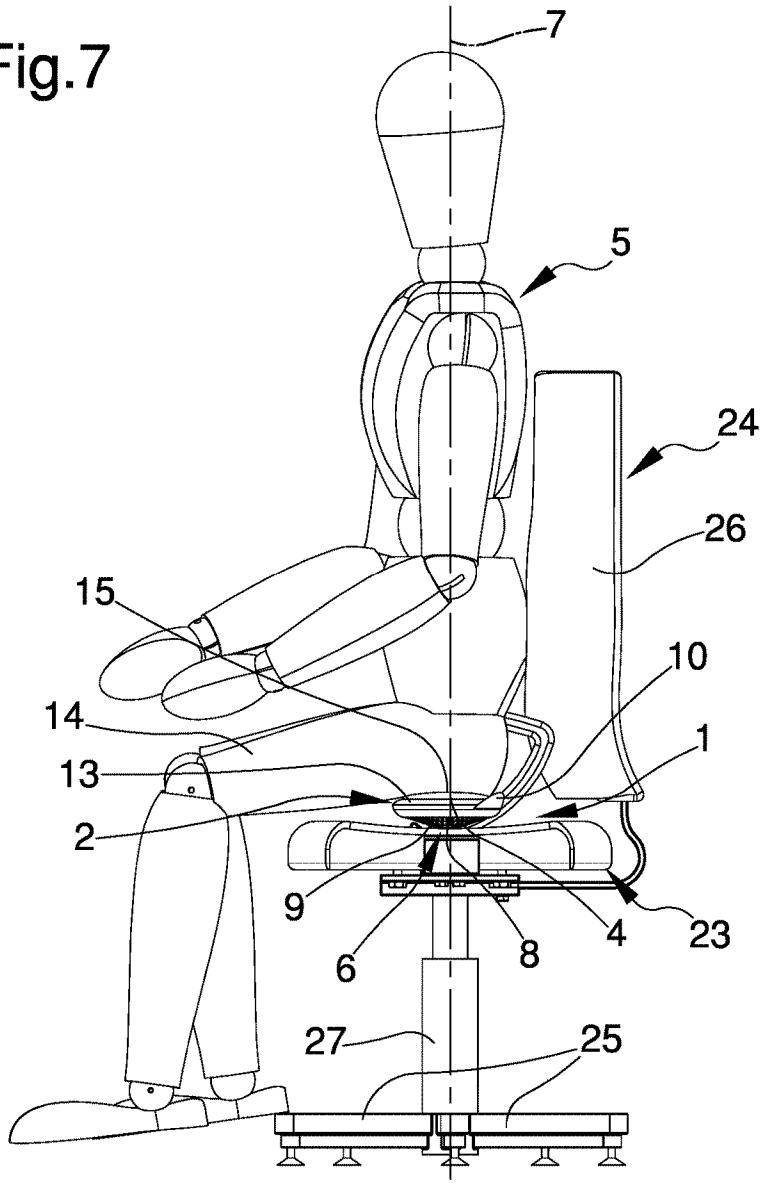
FIG. 7 is a partly sectional side view of the device according to the invention in the operating mode.

Alternatively, as shown in FIG. 6, the oscillating elements 2 have a substantially elliptical conformation.

Each oscillating element 2 has a central axis 7 and, with reference to the sitting position of the user 5, the buttocks 4 of the user 5 and the seating portion 3 are coaxial with each other.

The supporting portion 6 comprises a supporting surface 8 having a predefined radius of curvature; this means that the supporting portion 6 may have a more or less marked protrusion according to the extension of the radius of curvature itself.

With reference to a preferred embodiment shown in the figures, the supporting portion 6 is substantially hemispherical.

Moreover, the supporting portion 6 comprises a plurality of through holes 9.

The presence of the through holes 9 permits the aeration of the supporting portion 6.

Each of the oscillating elements 2 comprises a rear portion 11 which, with respect to the sitting position of the user 5, is provided with a lumbar sustaining portion 10.

As can be seen in the figures, the lumbar sustaining portion 10 is of the type of an abutment edge made of a material with a high coefficient of friction, i.e., adapted to prevent the user's buttocks from slipping beyond the margin of the oscillating elements 2.

In particular, the aforementioned material is flexible in such a way as to avoid the compression of a portion of the gluteus region of the user 5.

Preferably, the lumbar sustaining portion 10 is made at least partly in an anti decubitus material.

Advantageously, the lumbar sustaining portion 10 has a substantially curvilinear profile.

Alternative embodiments cannot also be ruled out wherein the lumbar sustaining portion 10 comprises a flat surface that develops from a rear portion 11, with respect to the sitting position of the user 5; this allows the user 5 to rest against the lumbar sustaining portion 10.

In addition, each of the oscillating elements 2 comprises a front portion 12 which, always with respect to the sitting position of the user 5, is provided with an ergonomic portion 13 adapted to receive and support at least one portion of the legs 14 of the user 5.

The ergonomic portion 13 has an inclined extension with respect to the central axis 7.

In particular, the ergonomic portion 13 is adapted to prevent the legs 14 of the user 5 from crushing against the margin of the oscillating elements 2.

Additionally, in order to improve the comfort of the oscillating elements 2, the seating portion 3 comprises padding means 15.

In particular, the seating portion 3 comprises a concave portion adapted to house the padding means 15.

The presence of the concave portion is adapted to increase the comfort of the seat of the user 5; in this case, the concave portion is substantially complementary to the buttocks of the user 5.

Preferably, the padding means 15 are made of a material commonly used by the technician expert in the field such as e.g. synthetic material and/or natural yarn. Alternative embodiments cannot also be ruled out wherein the padding means 15 are made of recycled material.

It cannot also be ruled out that the padding means 15 extend beyond the margins of the oscillating elements 2.

Furthermore, alternative embodiments cannot be ruled out wherein the padding means 15 are of the type of a layer of flexible material and going beyond the margins of the oscillating elements 2.

The oscillating elements 2 are associated with each other by interposition of connection means 16.

The connection means 16 have an elongated shape and comprise a connection element having a first ending part 17 associated with one of the oscillating elements 2 and a second ending part 18 associated with the other of the oscillating elements 2.

Figure 2:
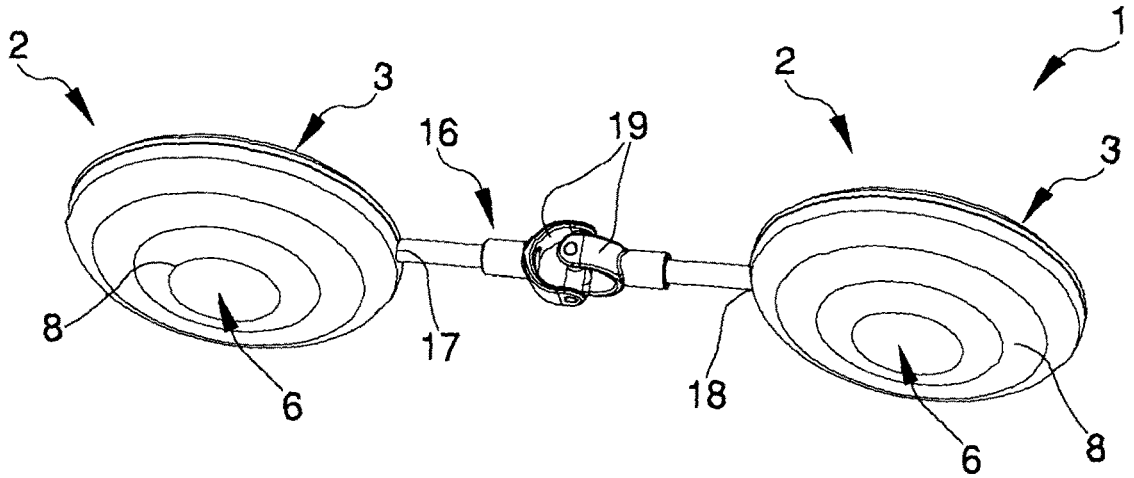
FIG. 2 is an axonometric view of the device according to the invention in a second embodiment.

In particular, the connection element 16 is the type of a universal joint 19 (FIG. 2).

The universal joint 19 is adapted to allow the free oscillation of an oscillating element 2 with respect to the other.

Figure 3:
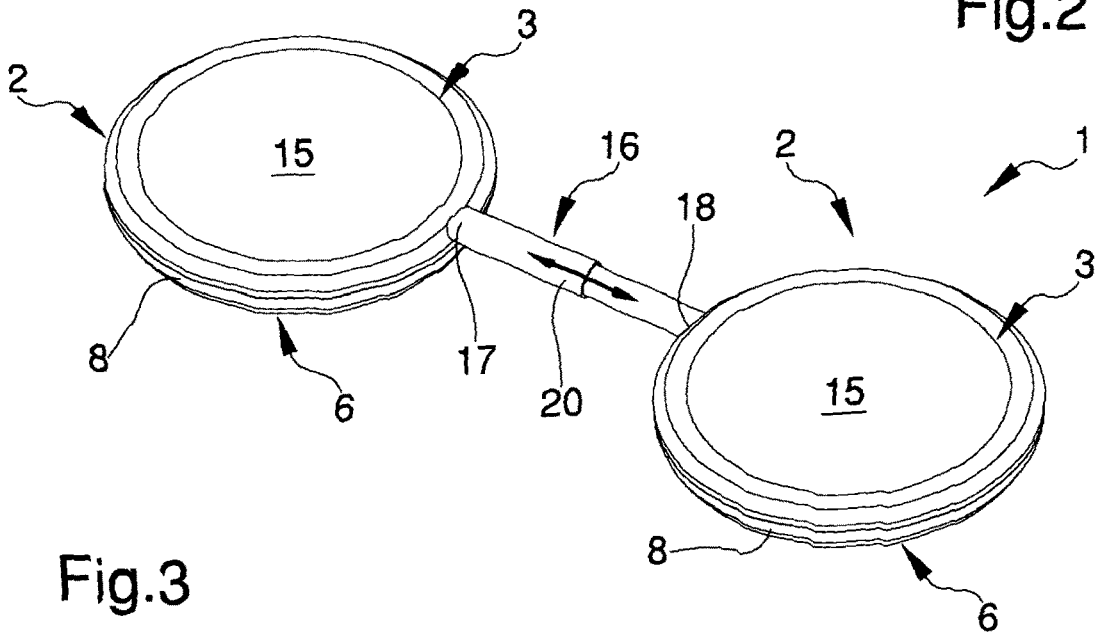
FIG. 3 is an axonometric view of the device according to the invention in a third embodiment.
Figure 4:
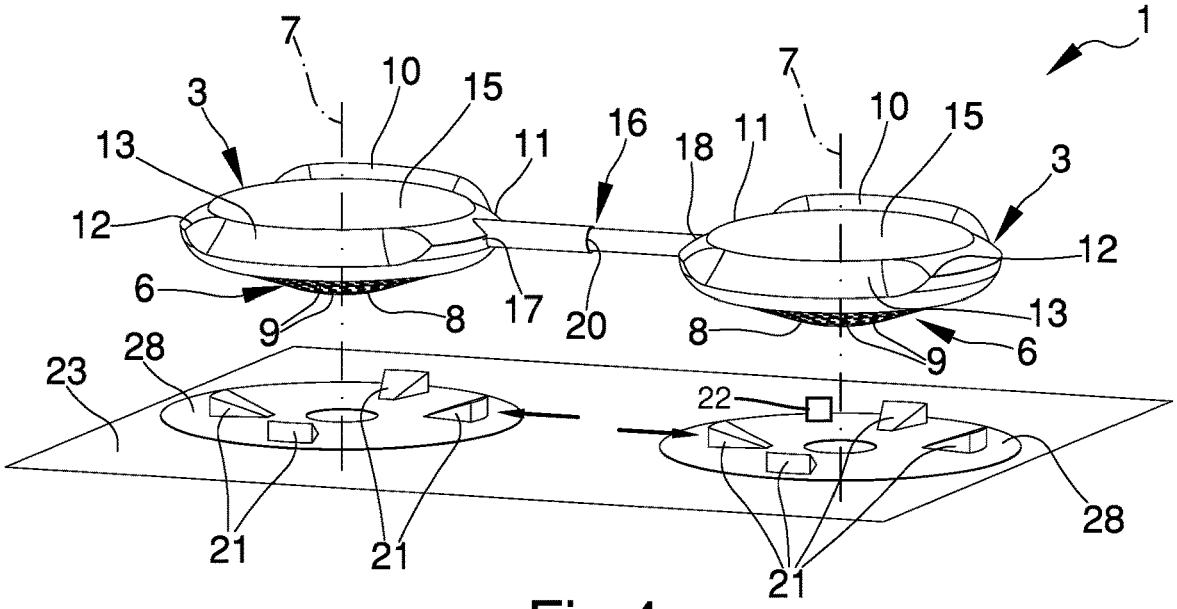
FIG. 4 is an axonometric view of the device according to the invention in a fourth embodiment.

In an alternative embodiment shown in FIGS. 1 and 3, the device 1 comprises adjustment means 20 for adjusting the distance of the oscillating elements 2. This way, the distance between the oscillating elements 2 is variable according to the bottom size of the user 5, thus ensuring the coaxial feature of each oscillating element 2 with the relevant buttock 4 of the user 5.

As can be seen in FIG. 1, the adjustment means 20 comprise an elastic element.

Alternatively, as can be seen in FIG. 3, the adjustment means 20 comprise a telescopic arm.

Furthermore, the device 1 comprises limitation means 21 for limiting the oscillation of the oscillating elements 2.

The limitation means 21 are adapted to vary the degrees of freedom of the oscillating elements 2; this allows modulating the oscillation of the oscillating elements 2 according to the specific needs of the user 5.

The limitation means 21 comprise a plurality of triangular-based limiting elements of the type of wedges.

Figure 5:
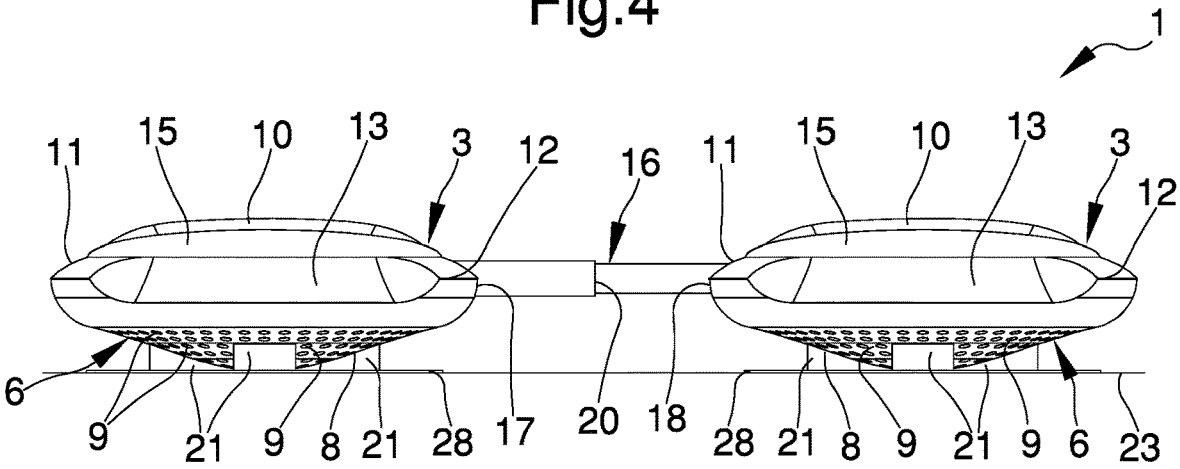
FIG. 5 is a front view of the device of FIG. 4.

As can be seen in FIG. 5, the limiting elements 21 are associated in a sliding manner with a substantially sheet-shaped base element 28.

The base element 28 has four limiting elements 21 arranged in a radial pattern on the latter and equidistant to each other.

The distance of each limiting element 21 with respect to the related oscillating element 2 can be modulated according to the degree of oscillation one wishes to obtain.

Alternative embodiments cannot also be ruled out wherein the limitation means 21 comprise a plurality of planar elements having a central hole and capable of being placed below the supporting portion 6. The planar elements can be stacked one onto the other in such a way as to make a thickness intended to decrease the degrees of freedom of each oscillating element 2.

Nevertheless, the possibility to stop the oscillation of the oscillating elements 2 cannot be ruled out; in fact, the device 1 comprises locking means 22 for locking the oscillation of the oscillating elements 2.

Preferably, the locking means are of the type of stops commonly used by the technician expert in the field and the thickness of which coincides with the distance between the seating portion 3 and a supporting surface 23 of the device 1 (FIG. 5).

Advantageously, the supporting surface 23 is of the rigid type.

The present invention also relates to a seat 23 for chairs 24, armchairs, or the like, comprising the device 1.

Furthermore, the present invention also relates to a chair 24 having bearing means 25 for resting to the ground, a backrest element 26 for the lumbar support of the user 5, a supporting surface 8 for the seat of the user 5, and the device 1. The chair 24 comprises height adjustment means 27 of the supporting surface 8. The height adjustment means 27 allow varying the distance from the ground according to the height of the user 5.

The operation of the present invention is as follows.

The device 1 is positioned on a seat 23 of a chair 24.

The user 5, sitting on the device 1, rests each of his/her buttocks 4 on the relevant oscillating element 2.

In particular, each buttock is coaxial to the relevant oscillating element 2; in other words, the centering of each buttock on the relevant oscillating element 2 ensures the distribution of the forces on the latter.

In detail, each buttock 4 is supported on the relevant seating portion 3.

The weight of the user 5, by discharging evenly on the oscillating elements 2 causes the oscillation thereof; the achievement of an unstable state of balance ensures the lumbar stimulation of the user 5.

The oscillation of the supporting surfaces 8 allows the user 5 to divide his/her weight so as to distribute evenly the oscillating forces on the sacral bone and/or on the pelvis.

In addition, the user 5 can modify the oscillation of the oscillating elements 2 through the use of the limiting elements 21, or possibly blocking completely the oscillation thereof by means of the locking means.

It has in practice been found that the disclosed invention achieves the intended objects.

In particular, it is emphasized that the particular solution of providing two oscillating elements associated with each other allows distributing the weight of the user evenly on the pelvis and/or on the sacral bone.

Additionally, the presence of the adjustment elements allows controlling, modulating, customizing and, if necessary, blocking the oscillation of the oscillating elements.

In addition, the fact of providing a lumbar sustaining portion and an ergonomic portion greatly increases the comfort of the device according to the invention.

The invention claimed is:

1. A dynamic postural device comprising two oscillating elements that each respectively have:

a seating portion to support a corresponding buttock of a user;

a supporting portion opposite to said seating portion and of a substantially convex shape comprising a supporting surface having a predefined radius of curvature and that is adapted to allow oscillation of each of the respective said two oscillating elements as a result of a seating of said user on said two oscillating elements, wherein said two oscillating elements are associated with each other by interposition of connection means having an elongated shape and comprising at least a connection element having a first ending part associated with one of said two oscillating elements and a second ending part associated with the other of said two oscillating elements, wherein said seating portion comprises a front portion that is configured to receive at least a portion of a leg of the user, and a back portion that is opposite to said front edge, wherein said one of said two oscillating elements is able to oscillate and rotate forward and backward, independent from said other of said two oscillating elements, about a longitudinal axis that extends through said two oscillating elements and said connection element; and wherein the dynamic postural device comprises adjustment means for adjusting a distance between said two oscillating elements.

2. The device according to claim 1, wherein said supporting surface comprises a substantially hemispherical shape.

3. The device according to claim 1, wherein said supporting portion comprises a plurality of through holes.

4. The device according to claim 1, wherein said connection element comprises a universal joint.

5. The device according to claim 1, wherein said adjustment means comprise an elastic element.

6. The device according to claim 1, wherein said adjustment means comprise a telescopic arm.

7. The device according to claim 1, wherein each of said two oscillating elements comprises a lumbar sustaining portion that is disposed at the back portion of said seating portion.

8. The device according to claim 7, wherein said lumbar sustaining portion comprises a raised abutment edge.

9. The device according to claim 1, wherein each of said two oscillating elements comprises a recessed ergonomic portion adapted to receive and support the portion of the leg of said user.

10. The device according to claim 1, wherein said seating portion comprises padding means.

11. The device according to claim 10, wherein said seating portion comprises a concave portion adapted to house said padding means.

12. The device according to claim 1, wherein the dynamic postural device comprises limitation means for limiting the oscillation of said two oscillating elements.

13. The device according to claim 1, wherein the dynamic postural device comprises locking means for locking the oscillation of said two oscillating elements.

14. A seat for chairs, armchairs, or the like, wherein the seat comprises the postural device according to claim 1.

15. A chair, comprising:

bearing means to a ground surface;

at least a backrest element for lumbar support;

at least a seat supporting portion for a seat of said user; and the postural device according to claim 1;

wherein the chair comprises height adjustment means for adjusting a height of said seat supporting portion.

16. The device of claim 1, further comprising a base element that comprises a first external cradle surface and a second external cradle surface, wherein the first external cradle surface and the second external cradle surface are configured to respectively cradle and articulate against the supporting surface of each of the two oscillating elements, wherein the base element comprises a first discrete component, and wherein the two oscillating elements and said connection means comprise a second discrete component that is configured to rest on, and be lifted from, the first discrete component.

* * * * *